US011939825B2

(12) United States Patent
Machocki

(10) Patent No.: US 11,939,825 B2
(45) Date of Patent: Mar. 26, 2024

(54) DEVICE, SYSTEM, AND METHOD FOR APPLYING A RAPIDLY SOLIDIFYING SEALANT ACROSS HIGHLY FRACTURED FORMATIONS DURING DRILLING OF OIL AND GAS WELLS

(71) Applicant: SAUDI ARABIAN OIL COMPANY, Dhahran (SA)

(72) Inventor: Krzysztof Karol Machocki, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 41 days.

(21) Appl. No.: 17/644,668

(22) Filed: Dec. 16, 2021

(65) Prior Publication Data

US 2023/0193706 A1 Jun. 22, 2023

(51) Int. Cl.

| | |
|---|---|
| ***E21B 17/10*** | (2006.01) |
| ***E21B 21/00*** | (2006.01) |
| ***E21B 33/138*** | (2006.01) |
| ***E21B 34/14*** | (2006.01) |
| ***E21B 37/00*** | (2006.01) |

(52) U.S. Cl.

CPC ..... *E21B 21/003* (2013.01); *E21B 17/1078* (2013.01); *E21B 33/138* (2013.01); *E21B 34/14* (2013.01); *E21B 37/00* (2013.01)

(58) Field of Classification Search

CPC .... E21B 21/003; E21B 21/00; E21B 17/1078; E21B 33/138; E21B 34/14; E21B 34/142; E21B 37/00

See application file for complete search history.

(56) References Cited

U.S. PATENT DOCUMENTS

| | | | | |
|---|---|---|---|---|
| 3,175,628 | A | 3/1965 | Dellinger | |
| 5,343,968 | A | 9/1994 | Glowka | |
| 6,131,675 | A * | 10/2000 | Anderson | E21B 10/322 175/383 |
| 6,955,216 | B1 | 10/2005 | Heijnen et al. | |
| 7,281,576 | B2 | 10/2007 | Curtice et al. | |
| 8,118,099 | B2 | 2/2012 | Moody et al. | |

(Continued)

FOREIGN PATENT DOCUMENTS

| | | |
|---|---|---|
| HU | 210197 B | 2/1995 |
| WO | 2009073656 A1 | 6/2009 |

(Continued)

OTHER PUBLICATIONS

Notification of Transmittal of the International Seach Report and the Written Opinion of the International Searching Authority issued in corresponding International Application No. PCT/US2022/053162, dated Mar. 15, 2023 (14 pages).

*Primary Examiner* — Catherine Loikith

(74) *Attorney, Agent, or Firm* — Osha Bergman Watanabe & Burton LLP

(57) ABSTRACT

A tool is used to inject a rapidly solidifying sealant into and across highly fractured oil and gas wellbore formations when a significant loss circulation zone or event is encountered. A system including the tool allows for application of the sealant to the formation without requiring removal of the drill string from the hole. The tool may have operatively associate with containers storing sealant and or sealant components that are provided downhole from the surface via wireline or the like.

11 Claims, 10 Drawing Sheets

(56) References Cited

U.S. PATENT DOCUMENTS

| | | | | |
|---|---|---|---|---|
| 8,936,097 | B2 | 1/2015 | Heijnen | |
| 9,045,975 | B2 | 6/2015 | Tonnessen et al. | |
| 9,068,439 | B2 * | 6/2015 | Walton | E21B 47/11 |
| 9,663,997 | B2 | 5/2017 | Kang et al. | |
| 9,982,508 | B2 | 5/2018 | Murphree et al. | |
| 10,018,011 | B2 | 7/2018 | Van Dongen et al. | |
| 10,851,616 | B2 | 12/2020 | Knight et al. | |
| 11,047,196 | B2 | 6/2021 | Rossing | |
| 2004/0011561 | A1 | 1/2004 | Hughes | |
| 2008/0000633 | A1 | 1/2008 | Xu et al. | |
| 2020/0325746 | A1 | 10/2020 | Lerbrekk | |
| 2020/0347686 | A1 | 11/2020 | Carisella et al. | |
| 2021/0040821 | A1 | 2/2021 | Hoffman | |
| 2021/0131233 | A1 | 5/2021 | Noske et al. | |

FOREIGN PATENT DOCUMENTS

| | | | |
|---|---|---|---|
| WO | 2009121882 | A1 | 10/2009 |
| WO | 2012150445 | A2 | 11/2012 |
| WO | 2016178004 | A1 | 11/2016 |
| WO | 2018048311 | A1 | 3/2018 |
| WO | 2018115053 | A1 | 6/2018 |
| WO | 2019091900 | A1 | 5/2019 |
| WO | 2021107785 | A1 | 6/2021 |

* cited by examiner

DEVICE, SYSTEM, AND METHOD FOR APPLYING A RAPIDLY SOLIDIFYING SEALANT ACROSS HIGHLY FRACTURED FORMATIONS DURING DRILLING OF OIL AND GAS WELLS

BACKGROUND

When drilling oil and gas wells using conventional methods, loss circulation events may result when the formation being drilled is highly fractured or otherwise contains large fractures. Expensive drilling mud or other drilling fluid that would otherwise flow up the annulus between the drill string and the wall of the wellbore to carry away cuttings and other materials is lost into the formation if the fractured formation is not addressed. Moreover, in normal drilling operations it is important to keep hydrostatic pressure on the annular side within a particular range for the drilled zone to prevent any influxes or hole collapse or, in more severe instances, kicks and even blowouts. Loss circulation due to large fractures in the formation may result in insufficient annular side hydrostatic pressure and may result in the aforementioned undesirable consequences.

One conventional approach to dealing with a loss circulation events is to stop pumping of drilling mud, and then pumping a specialized loss circulation material down the hole to block the fractures and thus prevent drilling mud from disappearing into the fractured formation. This procedure is time-consuming and expensive. When significant fractures or fracture zones are encountered, the typical loss circulation materials that are currently used are not effective.

Another approach to the problem of loss circulation events involves suspending drilling operations, removing the drill string from the wellbore, and running and cementing casing across the fractured zone of the formation. This procedure is also time-consuming and expensive.

In addition, when significant loss circulation events occur, it is typically necessary to refill the wellbore annulus around the drill string with an amount of drilling mud that was lost during the event. When the well location is remote, it may be difficult to maintain a sufficient supply of drilling mud on hand to account for such events, leading to additional costs and delay in drilling operations.

Accordingly, there exists a need for an improved tool, system, and method for dealing with loss circulation events resulting from drilling through highly fractured formations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to injector tools for injecting a special, rapidly solidifying sealant, precisely into the fractured formation voids, during drilling activities. Such a tool may be included in a standard drilling BHA in a passive mode and activated when required.

In another aspect of this disclosure, embodiments illustrated and described herein relate to methods of transporting the sealant down the hole in an inactive mode and activating the sealant when exiting a dedicated tool at depth, across the fractured formation, squeezing the sealant into the voids in formation.

In yet another aspect, embodiments disclosed herein relate to systems including injector tools, rapidly solidifying sealants suitable for filling and blocking or sealing voids in highly fractured formations through which a wellbore passes, and containers for storing and deploying the sealant at depth into the formations.

In another aspect, embodiments disclosed herein relate to systems having a single container for delivering a rapidly solidifying sealant that is activated by heat, pressure, or other conditions in the formation, or environmental conditions created by other components of such systems.

In another aspect, embodiments disclosed herein relate to systems having a multiple containers for delivering separate components of a material that, upon mixing of the separate components, becomes an activated rapidly solidifying sealant that may be injected or flowed into the fractured formation.

In another aspect, embodiments disclosed herein relate to systems for delivering rapidly solidifying sealant into a fractured formation via frangible darts pumped down the drill pipe to an injector tool.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
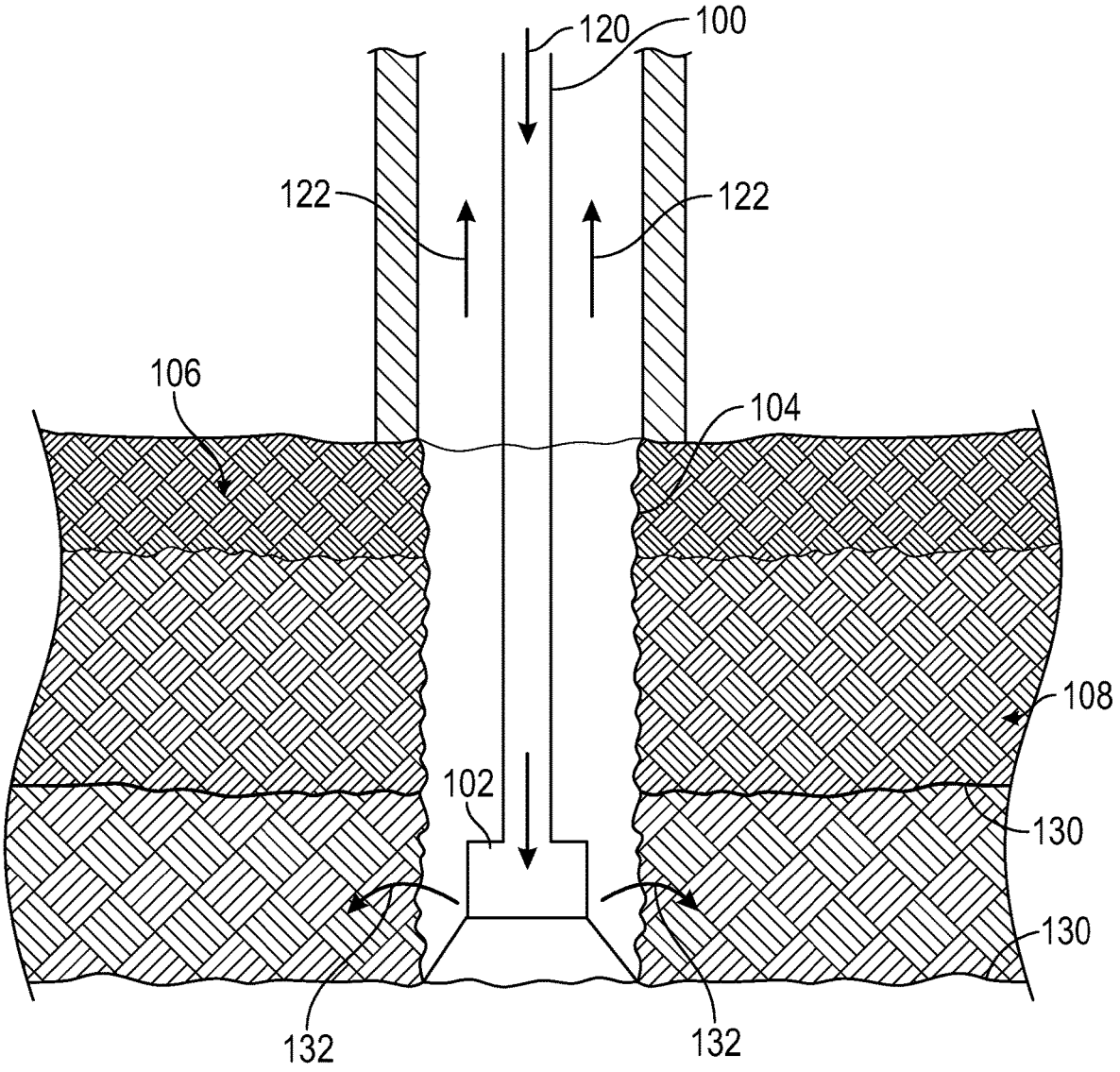
FIG. 1 is an illustration of a typical drilling operation in which a loss circulation event is occurring in accordance with one or more embodiments disclosed herein.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to apparatus, devices, tools, and methods for addressing and remedying loss circulation events during conventional drilling of subterranean and subsea oil, gas, and other types of wells. In conventional drilling, a bottomhole assembly ("BHA") typically comprising a drill bit (which is itself may be part of a drill bit sub), a mud motor, stabilizers, drill collar, jarring devices ("jars"), drill pipe, and crossovers for various threadforms is lowered into a surface hole to drill a wellbore or borehole. The BHA may also optionally include directional drilling and measuring equipment, measurements-while-drilling tools, logging-while-drilling tools, and other specialized devices.

As the BHA is advanced, drilling mud or other fluid is typically pumped down the drill string and out of the BHA through ports in the bit and/or bit sub. As rock cuttings and other material are created and displaced by the bit from the formation being drilled, the drilling mud entrains such cuttings and materials and floats and carries them up the borehole through an annulus formed between the drill string and the wall of the borehole, and eventually out of the wellbore for separation, treatment, and reuse of the drilling mud.

Typically, the circulating drilling mud provides a number of operational benefits during drilling, in addition to carrying away the rock cuttings created by the rotating bit. The weight of the column of mud in the borehole annulus provides hydrostatic pressure that helps maintain the integrity of the wall of the borehole until casing operations are commenced. The circulating mud also provides lubrication and cooling of the rotating drill string and all of the components of the drill string during drilling.

A problem arises when a drill bit enters or passes through a zone or region of a formation having significant fractures. The formation may be any geological formation from which drilling fluid such as oil or gas may be produced by drilling a wellbore and extracting the fluid from the formation. A wellbore may be any drilled hole used to extract hydrocarbons, gas, or water from the formation. Fractures are separations or cracks in geological formations that divide one or more rocks. Fractures may be microfractures, natural fractures, or hydraulic fractures.

More specifically, when significant fractured zones are encountered during drilling activities, the typical result is loss of expensive drilling mud into the formation and increased non-productive time spent address this problem. This is referred to as circulation loss, or a circulation loss event or occurrence. If not addressed and resolved, circulation loss may cause hydrostatic pressure in the wellbore annulus to drop, resulting in loss of the primary well barrier. In some occasions, the circulation loss event can result in a kick and even a blowout.

In some instances of circulation loss, pumping of drilling mud downhole is suspended and specialized loss circulation fluids are pumped down the drill string, out the BHA, and into the fractured zone of the formation in an effort to block the fractures and prevent further loss of drilling mud into the formation. However, when significant fractures are encountered, typical loss circulation fluids currently in use are not always effective.

FIG. 1 is a generalized illustration of a typical drilling operation in which a loss circulation event is occurring. A drill string 100 including a drill bit 102 is seen drilling a borehole 104 through different strata of a subterranean or subsea formation being drilled. The bit 102 has passed through a relatively solid layer 106 of the formation into a lower layer 108 having a significant fracture zone 130. In the absence of fractures in the formation, or prior to the drill bit 102 reaching the fracture zone 130, drilling mud pumped downhole through the drill string (as indicated by arrow 120) entrains rock cuttings and debris and carries it up borehole 104 and away from the bit 102 in the annulus 122 between the wall of the wellbore 104 and the drill string 100. Under normal conditions, the circulating drilling mud advantageously provides hydrostatic pressure in the borehole for maintaining integrity of the well during drilling operations, and cooling and lubrication for the rotating drill string 100.

In the situation illustrated in FIG. 1, normal circulation of drilling mud has been lost because the bit 102 has reached a fracture zone 130 in the formation. As a result, drilling mud is flowing into, and is being lost into, the fracture zone 130 (as indicated by arrows 132). Furthermore, upward flow of drilling mud in the annulus around the drill string 100 has ceased in this circumstance. When the drill bit 102 is advanced further into the formation and past the fracture zone 130, drilling mud will continue to be lost into the formation as it flows up the borehole and encounters the fracture zone 130, even where the bit 102 is once again drilling through relatively solid zones of the formation. The loss circulation event must be addressed and remedied in typical drilling operations.

Figure 2:
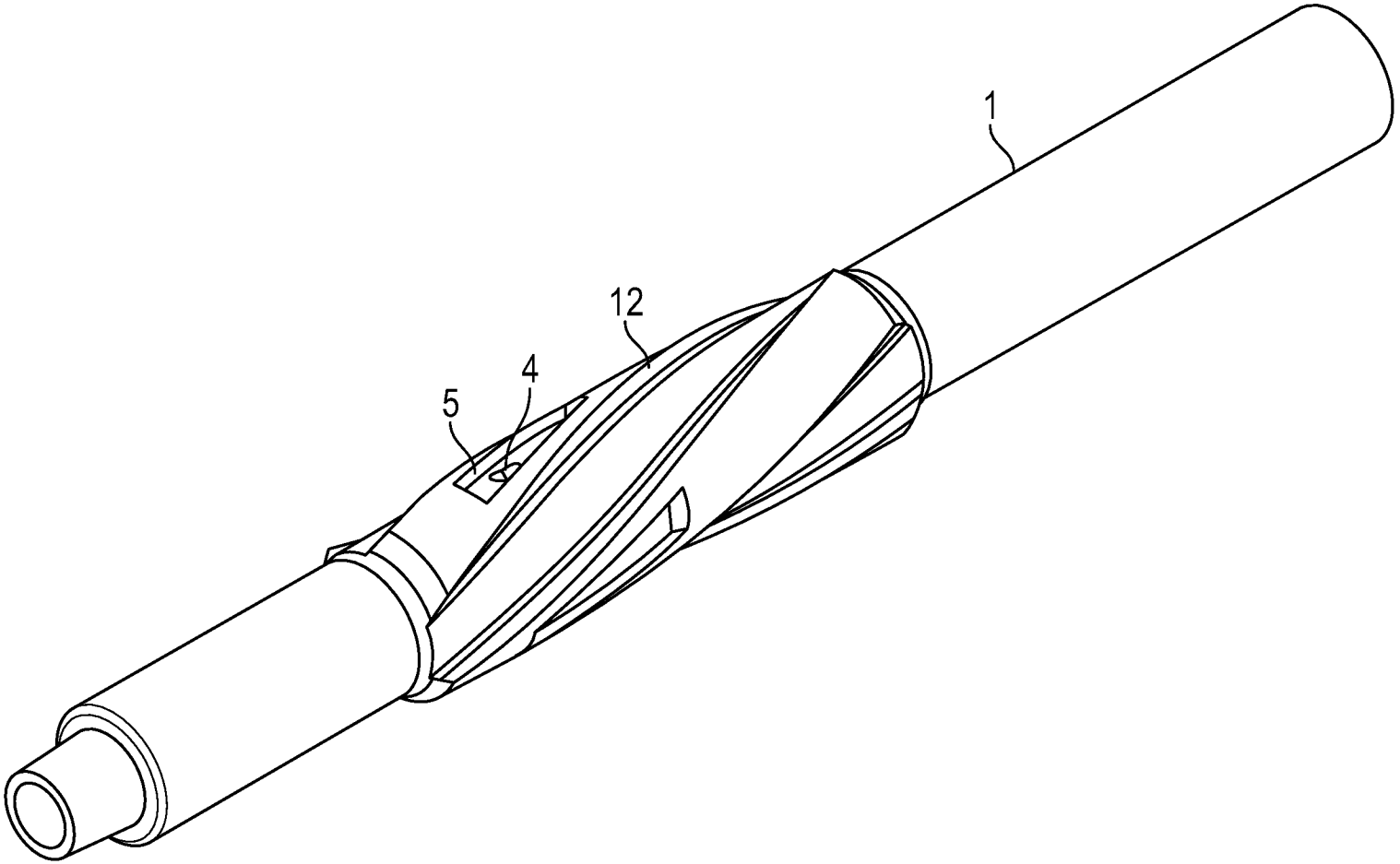
FIG. 2 is a perspective illustration of one embodiment of an injection tool.

FIG. 2 is a perspective illustration of one embodiment of an injection tool 1. Such an injection tool 1 may be part of a system which, in use, may perform a method for injecting a rapidly solidifying sealant precisely into the fractured formation voids of a wellbore during drilling activities. The sealant is configured to plug the voids even under a large differential pressure between the formation and the hole, thus preventing loss of drilling mud or fluid into the formation.

A system including an injection tool 1 such as in the following described embodiments may be incorporated into or included in a conventional drilling BHA. The injection tool 1 may be run downhole in a passive mode and activated when required in the event of detection of a loss circulation event or occurrence. Multiple different recipes, formulations, and materials may be used as the sealant, as long as the chosen material or combination of materials exhibits the property of rapid solidification in the anticipated downhole environment having known temperature, pressure, and other physical characteristics. Suitable sealants include cements, multi-part epoxy compounds, heat-activated single- or multi-part resin compounds, and the like as are known to persons having ordinary skill in the drilling arts.

The injector tool 1 of the embodiment shown in FIG. 2 is in the form of a typical BHA tool having suitably threaded ends and a generally hollow interior for allowing passage of drilling mud and other materials being pumped down to the drill bit. In the embodiment shown, the injector tool 1 includes radially projecting stabilizer pads 12 for providing contact between the BHA and borehole wall. While the stabilizer pads 12 are typically of conventional configuration, and three such pads are conventionally present on a BHA string stabilizer tool, one or more of the pads may be modified in accordance with embodiments of this disclosure. In some embodiments, the injector tool may be configured as a modified form of another typical BHA tool such as a BHA cleaning sub or other device or tool.

In the embodiment of FIG. 2, each stabilizer pad 12 has a displacement slot 5 in fluid communication with an injection port 4. The outside diameter of the stabilizer pads 12 of the injector tool 1 helps to align the displacement slots 5 directly across the fractured formation to direct the sealant mixture into the fractures when the tool is activated.

Figure 3:
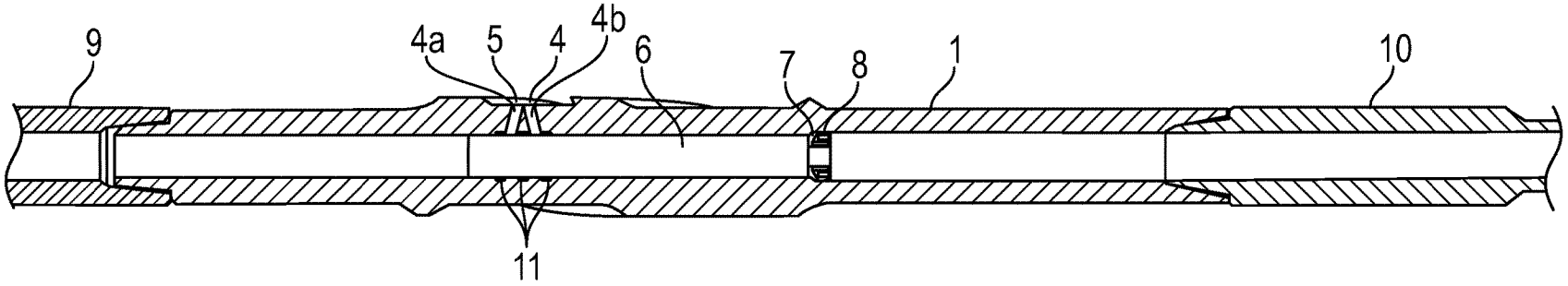
FIG. 3 is a cross-sectional view of the injection tool of FIG. 2 in an inactive condition during normal drilling operations in accordance with one or more embodiments disclosed herein.

In the embodiment of FIG. 3, the injector tool 1 is part of a system including, as well, a container catcher sub 9 connected in known fashion to the lower end (leftmost in the drawing) of the injector tool 1. The purpose and function of the container catcher sub 9 will be made more apparent upon further explanation of other components of the system. The upper end (rightmost in the drawing) of the injector tool 1 is likewise connected in known fashion to the lower end of the drill string 10 or, in some embodiments, to other components of the BHA. A generally hollow injection port cover dart 6, which may be cylindrical, is movably positioned within the central bore of the injection tool 1. In this embodiment, a typical dart latching mechanism 8 may be provided at an end or other location on the port cover dart 6 for engagement with the container seat face 7.

The port cover dart 6 may be moved from its inactive position shown in FIG. 3 in which the dart 6 sealingly blocks fluid communication between the inner bore of the injection tool 1 and the borehole external to the tool, to an activated position as will be further described. The outer surface of the injection port cover dart 6 may be provided with a number of seals 11, three in the illustrated embodiment, for providing additional blocking of fluid communication between the inner bore of the injection tool 1 and the borehole external to the tool. Seals 11 may be circumferential or may be configured in any other suitable manner as long as they sealingly isolate the innermost ends of the injection ports 4, only one of which is seen in the cross-sectional view of FIG. 3.

In the embodiment of FIG. 3, it is seen that the injection port 4 comprises first channel 4*a* and second channel 4*b* that are isolated from each other by a middle one of the seals 11 and by the wall structure of the injection port 1, until the channels 4*a*,4*b* meet at the outer surface of the tool 1, at and in the displacement slot 5 of the stabilizer pad 12. In embodiments employing multi-part sealants that solidify upon mixing of the separate components, this arrangement of separate channels 4*a*,4*b* provides a structure for keeping the separate components from contacting and mixing with each other until they have exited the injector tool 1. Such separate channels and sealing structures between them may be omitted in other embodiments making use of other types of rapidly solidifying sealants, such as single component sealants that are activated by, for example, contact with fluids or other materials encountered within the fractured formation be sealed.

Figure 4:
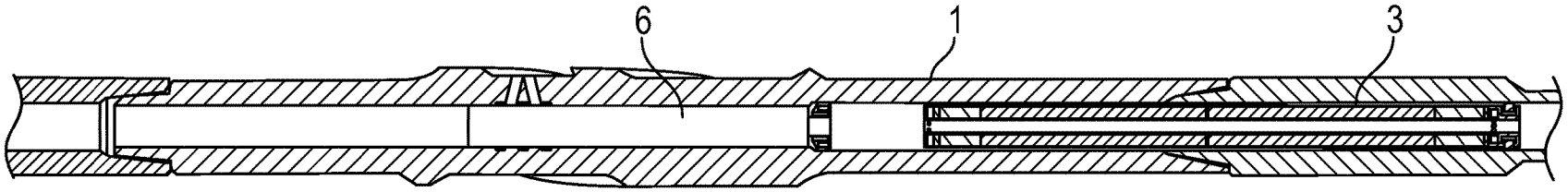
FIG. 4 is a cross-sectional view of the injection tool of FIG. 2 still in an inactive condition but being prepared for activation in accordance with one or more embodiments disclosed herein.

The injection tool 1 of the embodiment shown in FIGS. 3 and 4 further includes a container seat face 7 configured to catch a container 3 filled with sealant that is pumped down the drill string when remedying a loss circulation event is required. A container 3 may be configured similarly to downhole darts conventionally used for activating various downhole drilling tools, and may include a conventional dart latching mechanism 8 at an end or other location along its length.

As illustrated in the embodiment of FIG. 2, the displacement slot 5 may have one face offset at an angle from the longitudinal axis of the injector tool 1. Such an angled face allows for squeezing the sealant into the formation during slow rotation of the injector tool 1. This angle is preferably between 5 and 60 degrees.

As described hereinabove, the configuration of the system and its component parts, and its proper alignment across a fractured formation, is critical for preventing the sealant from solidifying around the tool and "cementing the tool in the hole." To this end, typically a small amount of sealant will be displaced on each attempt to cure the loss of drilling mud into the fractured formation. Displacement of small amounts of sealant also help to prevent cementing the tool in the hole.

Nonetheless, more than one container may be pumped down to the injector tool 1 when larger volume displacement of sealant is required, or when multiple sealing operations are necessary at different depths during drilling operations. In other embodiments (not shown), the injector tool 1 may allow for a coil or umbilical to be run from the surface and latched into the injector tool 1, instead of pumping down separate containers of sealant, to allow pumping higher volumes of sealant from the surface directly into the formation. This embodiment and method can be beneficial when attempting to fill larger caves and openings with rapidly solidifying sealant. Such techniques are especially suited for use with single-component sealants or, in the case of multi-part sealants, with a dart that precisely engages the injector tool in the required position so as to deliver two different components of a sealant into the separate channels 4*a*,4*b* of the injection port 4.

In another embodiment illustrated schematically in FIGS. 9-12, an injection tool 901 is positioned in a wellbore 903 through a formation 905 that has a fractured zone 907 giving rise to a loss of mud and/or other drilling fluids into the formation. The injection tool 901 includes one or more injection ports 911 which are initially sealed against fluid communication between the inside of drill pipe 915 and the annular space between the drill pipe 915 and the wall of the wellbore 903. Such a seal may be provided by, for example, rupture disks (not shown). The injection tool 901 is also provided with a dart landing seat 913 positioned within the central bore of the tool and below or past the inner ends of the injection ports 911, the function of which will be apparent from the following further disclosure.

The injection tool 901 may be one part of a BHA and in some embodiments may include externally protruding stabilizer pads as previously mentioned.

Figure 9:
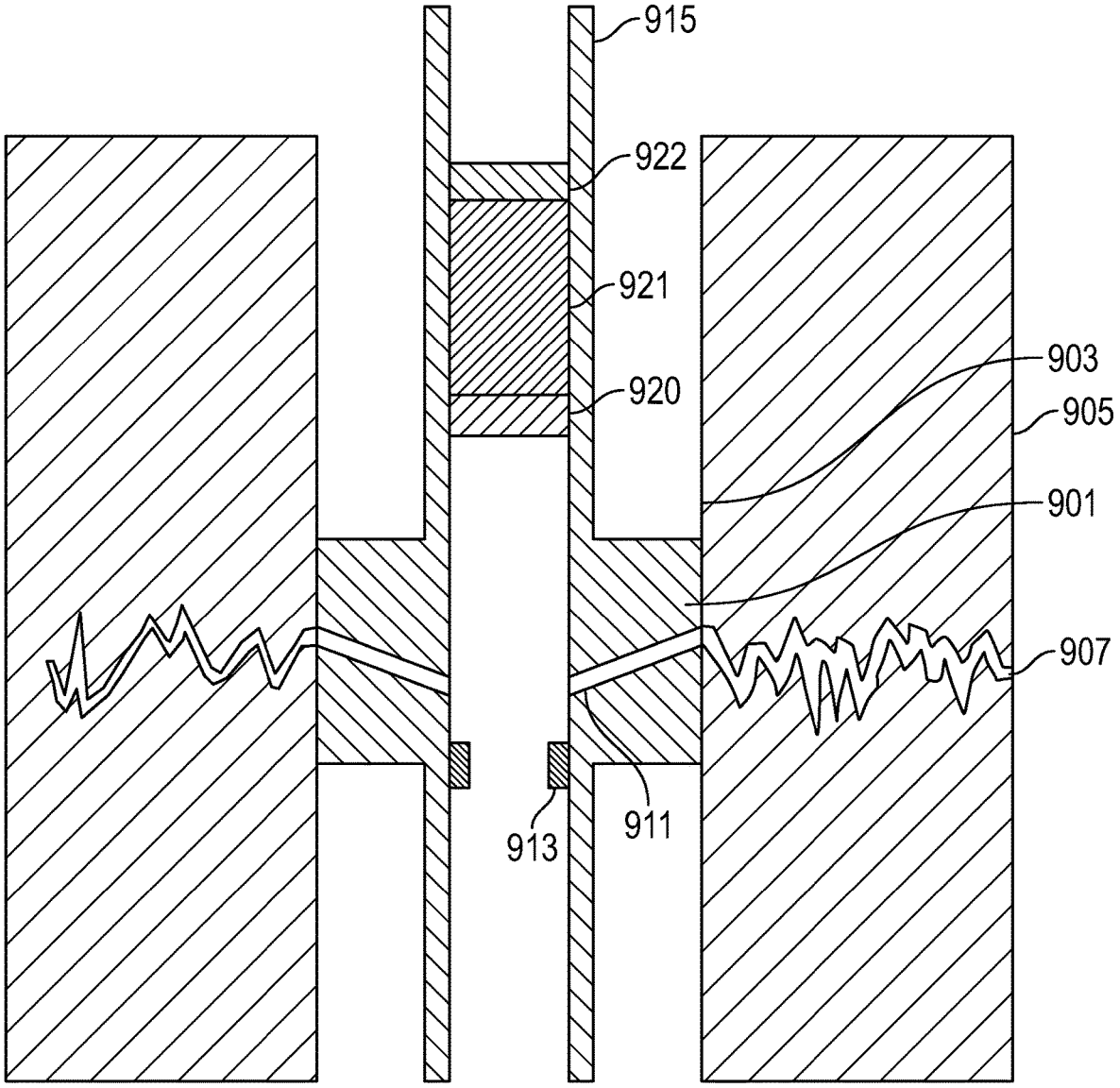
FIG. 9 is a cross-sectional schematic illustration of an operational state of an embodiment in which sealant positioned between rupture darts is pumped down to an injector tool.

As seen in the embodiment of FIG. 9, a first dart 920 in the general form of a plug and a second dart 922 also in the general form of a plug are located above the injection tool 901, having been pumped down from the surface to a position just above the fractured zone 907. A rapidly solidifying sealant 921 which may be a cement is contained in the volume within the drill pipe 915 or BHA between the first and second darts 920,922.

Figure 10:
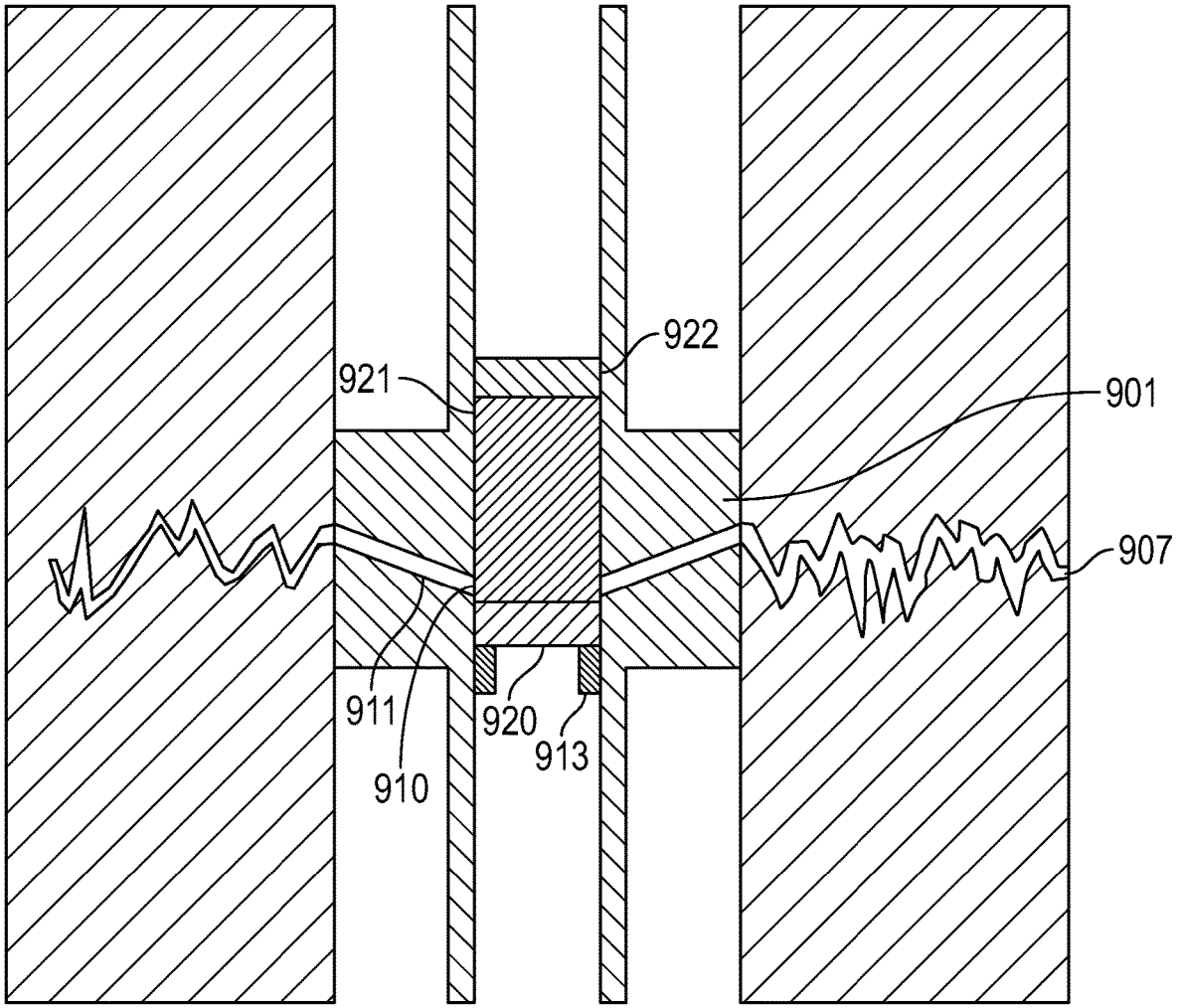
FIG. 10 is a cross-sectional schematic illustration of a further operational state of the embodiment of FIG. 9.

Referring to FIG. 10, it is seen that the combination of the first and second darts 920,922 and the sealant 921 between them has been further pumped down into a position at least partially within the injection tool 901, such that the sealant 921 is adjacent the inner ends 910 of the injection ports 911. The position of the sealant 921 with respect to the inner ends 910 of the injection ports 911 is controlled in one embodiment by the position of the dart landing seat 913. As illustrated in FIG. 10, the system is ready for injection of the rapidly solidifying sealant 921 into the fracture zone 907.

In one embodiment of use of the system illustrated in FIG. 10, pressure is increased in the drill pipe 915 to a pressure that is sufficient to cause rupture disks (not shown) in the injection ports 911 to rupture. When the rupture disks rupture, elevated pressure in the drill pipe 915 forces the second dart 922 (illustrated as the upper dart) towards the first dart 920, thereby squeezing the volume of rapidly solidifying sealant through the injection ports 911 and into the fractured zone 907 of the formation 905. As previously mentioned, in some embodiments the injection tool 901 may be slowly rotated during this sealant injection process.

Figure 11:
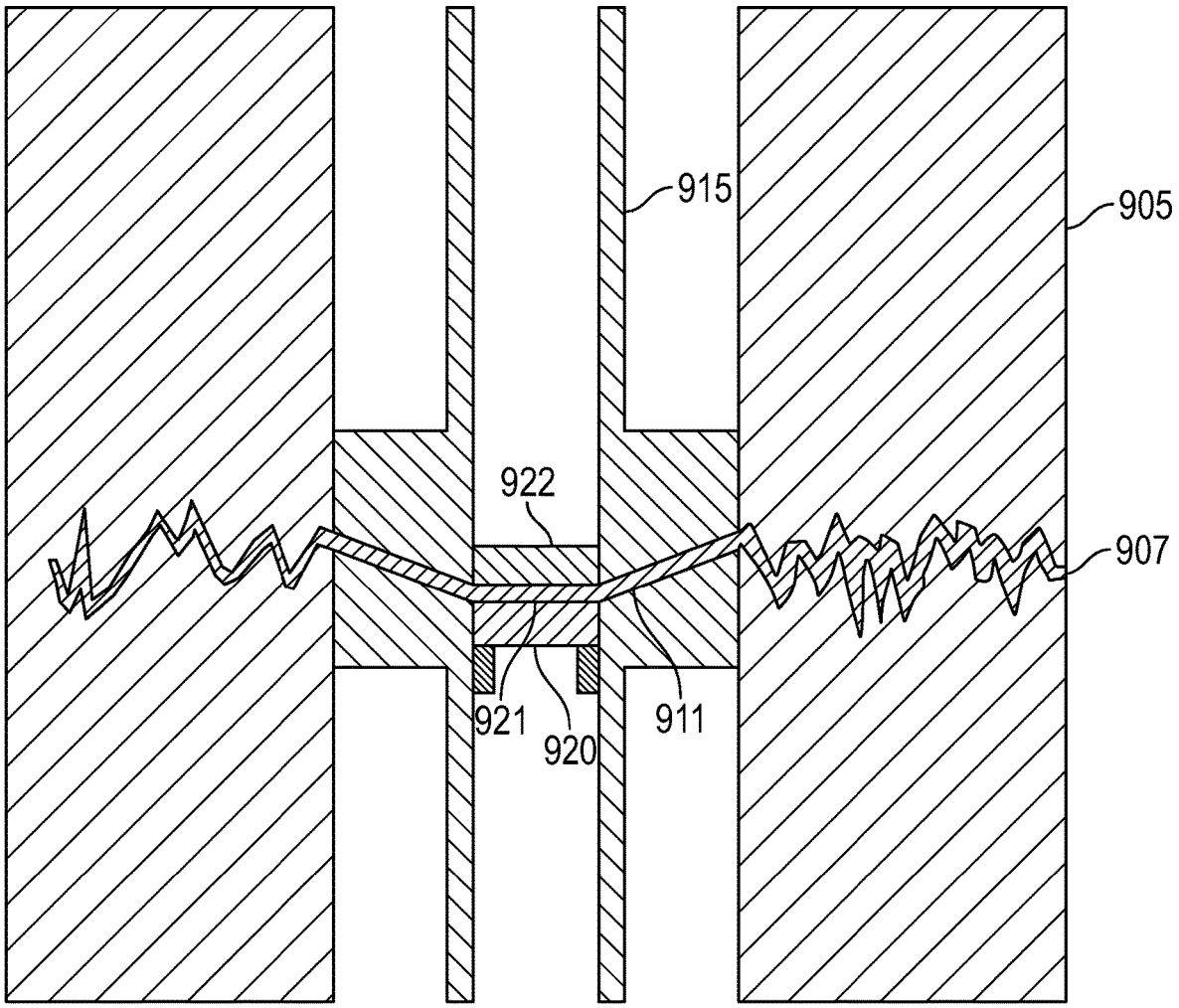
FIG. 11 is a cross-sectional schematic illustration of a still further operational state of the embodiment of FIG. 9.

As seen in the embodiment of FIG. 11, the sealant injection process is nearly finished. In some embodiments, the volume within the drill pipe 915 or BHA between the first and second darts 920,922 may be divided into one or more separate compartments such that the last portion of material forced through the injection ports 911 is a cleaning material or fluid for preventing solidification of the sealant 921 within the injection ports 911. In this manner, multiple successive volumes of sealant may be pumped into the fractured zone 907 of the formation 905.

Figure 12:
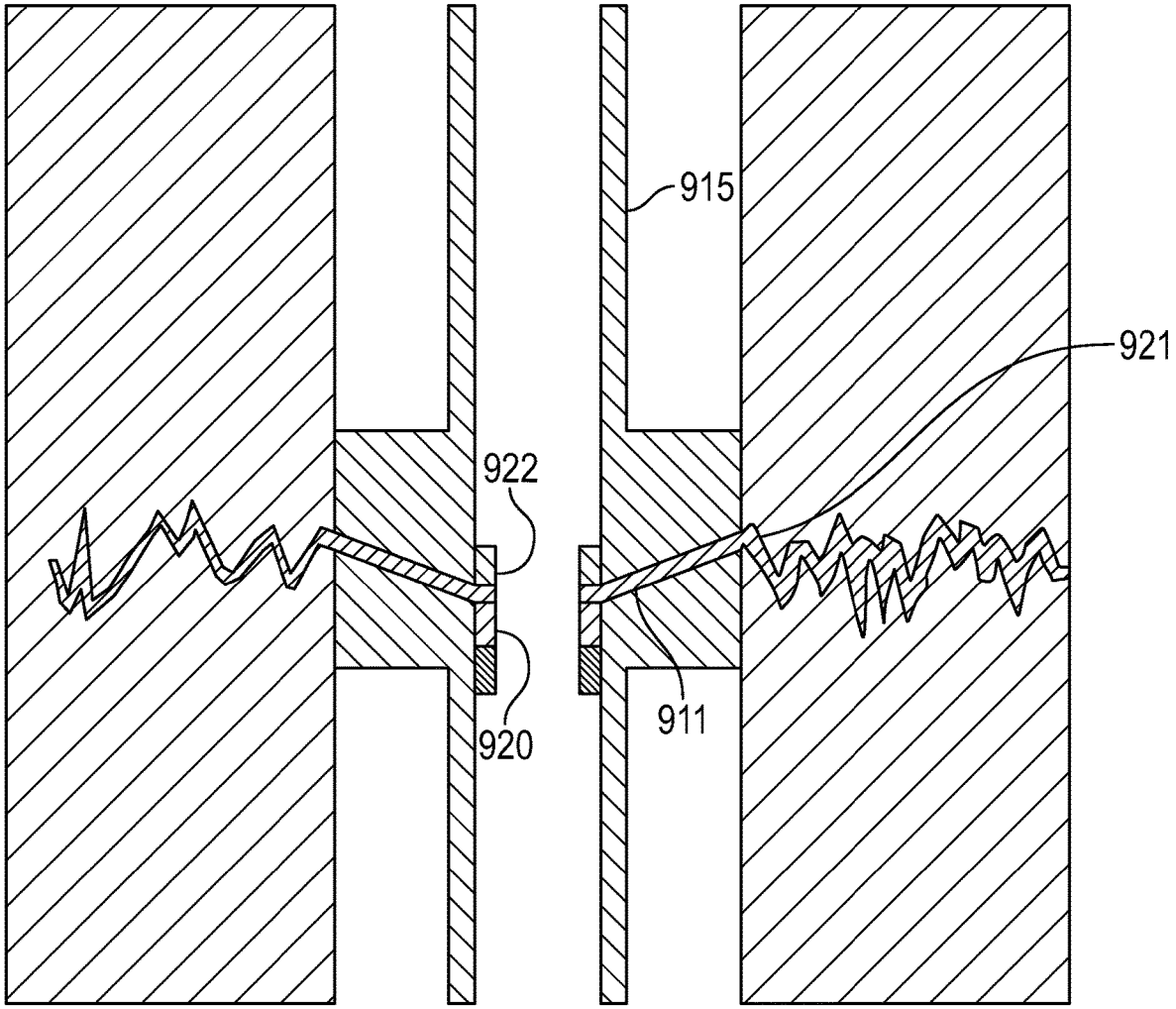
FIG. 12 is a cross-sectional schematic illustration of a further operational state of the embodiment of FIG. 9.

In an embodiment shown in FIG. 12, the rapidly solidifying sealant 921 has been allowed to solidify in the injection ports 911. Once that has occurred, pressure within the drill pipe 915 may be further increased to a pressure sufficient to rupture the first and second darts 920,922, thus restoring fluid communication down the drill pipe 915 to the drill bit. Any remaining annular portions of the darts 920, 922, illustrated as present in FIG. 12, may remain in place. Normal drilling operations may then be resumed. Alternatively, any remaining portions of the darts 920.922 may disintegrate or otherwise break apart and be forced down to and out through the drill bit. In such an embodiment, a last or final portion of material squeezed into the injection ports 911 may be chemically, thermally, or otherwise removable from the ports 911 so that one or more additional and successive volumes of sealant and other materials may be pumped down to the injection tool 901 between additional pairs of darts for further injection into the fractured zone 907.

Figure 6:
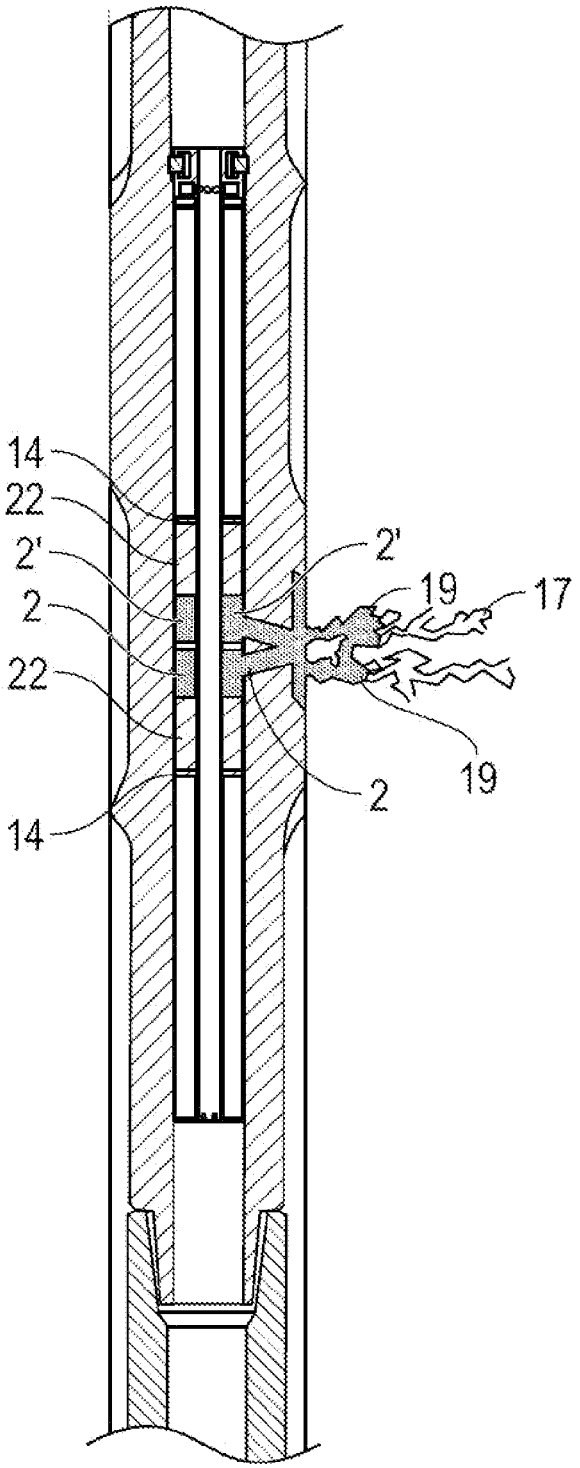
FIG. 6 is a cross-sectional view of the injection tool of FIG. 2 after activation in accordance with one or more embodiments disclosed herein.

Typically, a rapidly solidifying sealant will be used. Such sealant is required to expand, solidify, and harden when exiting the displacement slot 5 in such way that sealant will get injected into the fractured formation 17 and in such hardened condition 19 will block the voids under a high differential pressure acting on the sealant and pushing it through the voids during solidification, as seen in FIG. 6.

In one embodiment, sealant can be pre-installed into an annular chamber of the injector tool 1 or in a form of the container 3 that has a annular configuration with a through-bore. In some embodiments, the injector tool 1 or the container 3 will have an activation feature to allow a pressure build-up to squeeze the sealant out of the tool 1 or container 3 and thereby pump it through the injection ports 4. Typically, in such embodiments either the injector tool 1 or the container 3 might consist of a ball-catching seat for releasably receiving the well operator to pump a ball from the surface down the drill pipe to reach the dedicated ball-catching seat and generate pressure build-up when and where required. Once operations of pumping sealant are completed, such ball would then be released to unblock the internal bore of the injector tool 1 and allowing drilling fluid to be pumped again to the drill bit.

In one embodiment as illustrated in FIGS. 5, 6, and 7A, 7B, and 7C, a two-part sealant may comprise a first part 2 and a second part 2' which may be a catalyst or the like, similar to epoxy and epoxy hardener, which, when mixed upon exiting the injection ports 4 of the injector tool 1, form the activated flowable sealant that then rapidly expands and quickly solidifies to seal the fractured formation. In other embodiments, a meltable material such as bismuth or the like may be used. Such a material may be melted with an aid of a thermal actuator (not illustrated), such as burning various thermite compositions in a controlled way to heat the sealant to temperatures of at least 600° C. during the step of flowing the sealant material out of the container 3 and injector tool 1. Such meltable sealants will solidify rapidly as soon as they have been displaced sufficiently far from the heating source within the container 3 and/or injector tool 1 (not shown) and when the temperature has dropped below the melting point of the material, typically to less than 300° C. Examples of fuels in thermite compositions include aluminum, magnesium, titanium, zinc, silicon, and boron. Aluminum is common because of its high boiling point and low cost. Oxidizers in thermite compositions include bismuth(III) oxide, boron(III) oxide, silicon(IV) oxide, chromium(III) oxide, manganese(IV) oxide, iron(III) oxide, iron (II,III) oxide, copper(II) oxide, and lead(II,IV) oxide.

In some embodiments, typical cement for cement casing in the well may be even used. In some embodiments, large volumes of sealant, including cement, can be pumped from the surface to displace across the larger fractures. As previously disclosed in connection with the embodiment of FIGS. 9-12, multiple volumes of sealant positioned between pairs plug darts may be pumped down the drill pipe to an injector tool, with each volume being dispensed into the fractured formation through the injector ports of the injector tool, the plug darts then being ruptured to allow the successive following volume to be pumped into position on the plug dart landing seats, and the process repeated as many times as necessary to seal the fractures.

Figure 5:
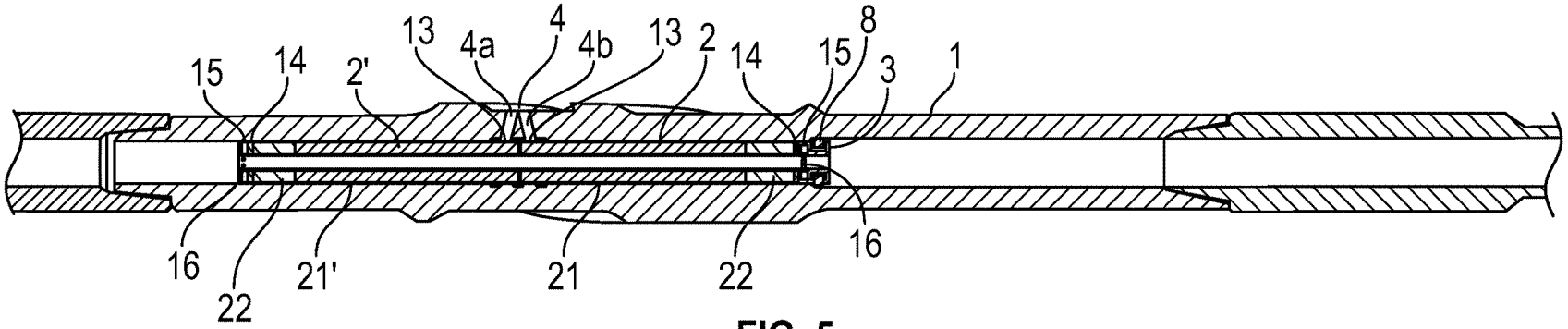
FIG. 5 is a cross-sectional view of the injection tool of FIG. 2 in an activated condition in accordance with one or more embodiments disclosed herein.

As illustrated in the embodiment of FIG. 5, container 3 is provided with a conventional dart latching mechanism 8 (which will typically be identical to the dart latching mechanism of the port cover dart 6), which is configured to engage the container seat face 7 of the injector tool 1. The container 3 is sized to be accurately positioned for delivery of a multi-part sealant when the dart latching mechanism 8 is appropriately engaged.

In an embodiment (not shown), the container 3 may have a single annular sealant chamber therein for transporting one fluid or material, such as a meltable sealant or, alternatively, a cement material prepared at the surface and packaged into the container at the surface. Time delay solidifying or temperature controlled solidifying cements and the like are suitable. In the illustrated embodiment, the container 3 is provided with multiple separate annular chambers 21,21',22 arranged in end-to-end fashion, in which chambers 21 and 21' contain two parts of a multi-part expanding, rapidly solidifying sealant, and optional chambers 22 (one at each end, above and below chambers 21 and 21') may contain a third material, such as a port cleaning fluid or solvent or other material as desired. When optional chambers 22 are included and contain a port cleaning fluid or the like, the cleaning fluid will be displaced from the injection tool 1 through the channels 4*a*,4*b* of the injection port 4 thus preventing the fluid passages from themselves becoming sealed, and thus allowing reuse of the injection tool for subsequent injection of additional sealant, if necessary or desired.

As shown in the embodiment of FIG. 5, typically, container 3 will be fitted with a type of dart latching mechanism 8 to engage with the container seat face 7 inside the bore of the injector tool 1. In addition, container 3 will typically comprise one or more pistons 14 which, upon being moved toward the injection ports 4, force the sealant components 2,2' in the respective container chambers 21,21' to flow into the separate channels 4*b*,4*a* of the injection ports 4 and out of the tool where they will mix, expand, rapidly solidify, and harden in the voids of the fractured formation.

In a disclosed embodiment, the sealant parts 2,2' may be squeezed out of their respective chambers by increasing the pressure inside the drill string and thus inside the bore the injector tool 1. High pressure fluid will flow into high pressure chamber 15 located at each end of the pistons 14 through fluid connection ports 16 and will thereby act on the pistons 14 to drive them and the fluids inside the chambers towards the injection ports 4. In some embodiments, the container 3 might include one or multiple rupture disks 13 that will rupture and open generally at the same time in response to high pressure exerted by the fluids 2,2' inside the chambers 21,21' when pressure inside the tool has been sufficiently increased above the rupture threshold of the disks 13.

Figure 8:
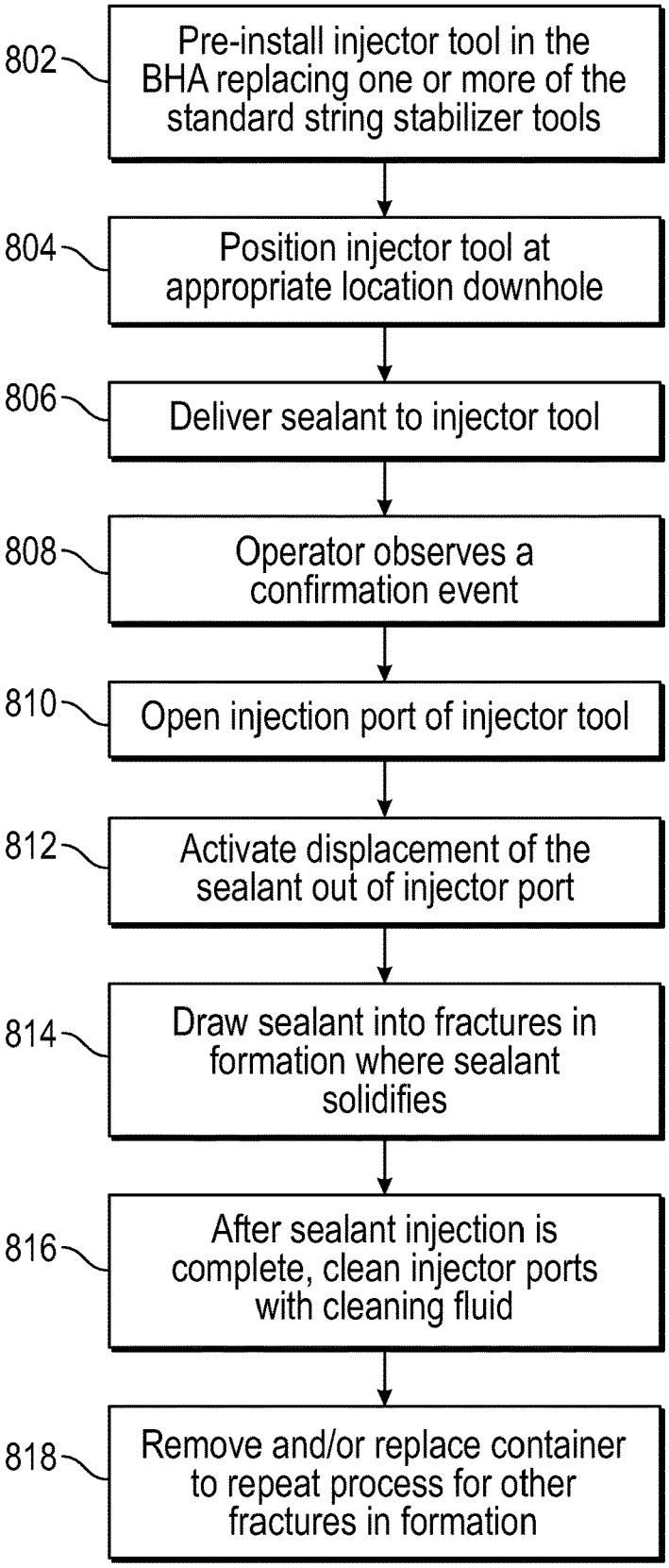
FIG. 8 shows a flowchart for a method of sealing fractures of a formation in accordance with one or more embodiments.

With reference to the flowchart of FIG. 8, an embodiment of a method for using the system and injector tool 1 of the above-described embodiments is as follows.

The injector tool 1 may be pre-installed in the BHA replacing one or more of the standard string stabilizer tools otherwise employed (Block 802). Where three stabilizers would be installed in the BHA, one of them may be replaced with the injector tool 1 in such way that standard drilling operations will not be affected. Other combinations of downhole tools, and substitution of other BHA tools, or merely the addition of the injector tool 1 at any suitable position in the BHA, is contemplated.

In some embodiments, the injector tool 1 may be included in an alternative BHA assembly designed specifically for use in deal with loss circulation events, similar to a hole cleaning assembly used for a well-cleaning run. In this situation, however, use of the injector tool would first require withdrawal of the drill string from the wellbore, and is thus not preferred.

The injection ports 4 of the injector tool 1 are initially closed and all drilling fluids are circulated from surface to the bit. No fluids exit through the injection ports 4 during normal drilling operations. In some embodiments, the injection port cover dart 6 may be used to close and open the injection ports 4 when required.

Typically, when a significant loss circulation event occurs, the depth of the fractured formation 17 is recorded. The injector tool 1 may be precisely positioned across the fractured formation 17 in such way that the injection ports 4 and the displacement slots 5 are positioned directly across the fractures in the formation. In other embodiments, depending on buoyancy of the particular sealant to be used downhole drilling mud in place, the injector tool 1 could be positioned above or below the fractured formation when starting the sealant displacement into the fractured formation 17.

After positioning the injection tool 1 at the appropriate location (Block 804), a container 3 with a multi-part sealant 2,2' may be inserted into the drill string at the surface, and pumped down inside the drill string to the container seat face 7 inside the injector tool 1 (Block 806). Alternatively, in one or more embodiments, the injection tool 1 may be pre-installed with the sealant rather than sent from the surface in a container. When the container 3 reaches the container seat face 7 inside the injector tool 1, the operator at the surface observes a confirmation event which, in some embodiments, may be a pressure increase within the drill string, thus confirming the correct landing of the container 3 inside the injection tool 1 (Block 808). In some embodiments, other confirmation methods typically used in oil and gas drilling tools can be used such as: pressure fluctuation, down hole telemetry (mud pulse, acoustic telemetry, etc.), and other known techniques.

Next, the injection port of the injector tool is opened (Block 810). In some embodiments, the container 3 pushes the injection port cover dart 6 out of its initial position. In such embodiments, the injection port cover dart 6 will disengage the container seat face 7 and travel into the container catcher sub 9 located below the injector tool 1. In other embodiments, other methods for opening the injection ports 4 may be employed.

Figure 7A:
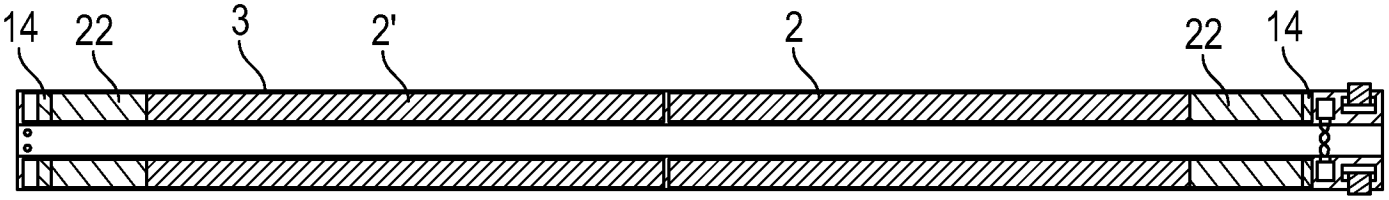
FIG. 7A is a cross-sectional view of an embodiment of a container suitable for use in the embodiment of an injection tool as illustrated in FIG. 2 in a first operational state.

In any case, once the container 3 lands on the container seat face 7, the injection ports 4 will typically open. At this point in operation of the devices and system of one of the disclosed embodiments, the configuration will be as is shown in FIGS. 5 and 7A. At such time, an increase in pressure within the drill string activates the displacement of sealant out of the container 3 (Block 812), first by rupturing the rupture disks 13 as opposed movement of the pistons 14 as the opposite ends of the fluid chambers is initiated. As the pistons 14 continue to travel towards each other, the separate sealant components 2,2' will flow into the channels 4*b*,4*a* of the injector port 4, and upon reaching the outermost extent of the channels the sealant components will mix together to form the expanding rapidly-solidifying sealant material 19.

During injecting of the sealant into the fractured formation 17, the injection tool 1 may be slowly rotated with entire drill string. Such slow rotation may be at rotational speeds of 5-30 RPM in some embodiments. In some situations, the pressure differential across the wellbore and fractured formation will help to draw the sealant into the fractures 17 and solidify 19 within (Block 814).

Figure 7B:
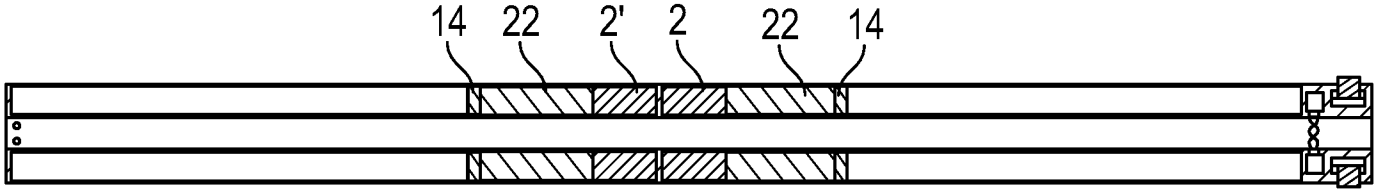
FIG. 7B is a cross-sectional view of the container of FIG. 7A in a second operational state in accordance with one or more embodiments disclosed herein.
Figure 7C:
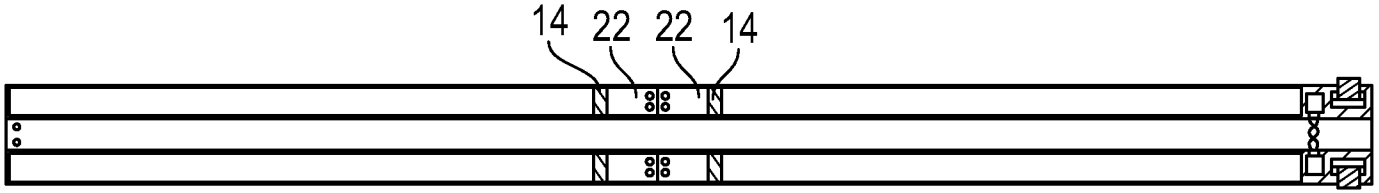
FIG. 7C is a cross-sectional view of the container of FIG. 7A in a third operational state in accordance with one or more embodiments disclosed herein.

In the condition of the container 3 illustrated in FIGS. 6 and 7B, most of the volume of the sealant components 2,2' have already been pushed out of their respective chambers 21,21'. In the condition of the container 3 illustrated in FIG. 7C, cleaning fluids or solvents or other fluids stored in optional chambers 22 have been mostly pushed out through the injection port 4. In general, once the sealant injection process begins, all chambers of the container 3 will be emptied in one attempt of plugging the fractured formation 17 and curing the circulation losses.

Once the mixed sealant components exit the injector tool 1, they will be squeezed towards the fractures 17 and/or flow towards the fractures and solidify rapidly 19 therein. It may occur in some embodiments that only some of the sealant will enter the fractured formation solidify therein, thus sealing the fractures. The remaining sealant that can no longer flow into the fractured formation may solidify inside the wellbore, but is be sufficiently displaced from the drill string by the stabilizer pads so as to allow for the continued upward flow of drilling mud when normal drilling operations are resumed. In addition, hardened sealant in this situation will typically be crushed between the BHA and the wellbore and will flow back to surface with cuttings during normal drilling circulation.

In some embodiments, once all of the sealant has been squeezed out of the container 3, the cleaning fluids will next be squeezed out through the same path to clean the injection ports 4 and displacement slots 5 (Block 816), as previously disclosed.

When a container 3 has been emptied, it could be disengaged from the container seat face and moved below the injection tool 1 into the container catcher 9 sub. In some embodiments, an empty container 3 may be removed and replaced with a second, similar container and an additional application of sealant may be initiated (Block 818). This may be repeated multiple times as necessary for each fracture to be sealed.

After the fractured formation has been successfully plugged, in one embodiment, the last-emptied container may be removed by use of another injection port cover dart 6 that will close the injection ports 4 and restore the fully sealed internal diameter of the central bore of the injection tool 1.

In some embodiments, the container 3 may be manufactured from a dissolvable material, such as magnesium, and dissolve after emptying it down the hole or once moved inside the container catcher sub 9. In other embodiments, the empty container or containers may be fished out with a conventional wireline fishing tool deployed inside the drill string.

After removing the container or containers from the BHA, in the case of non-dissolvable or non-frangible containers, then normal drilling operations may be resumed.

Embodiments of the present disclosure may provide at least one of the following advantages. The rapidly solidifying sealant is required to harden/expand/solidify when exiting the displacement slot in such way that sealant is injected into the fractured formation and block the voids under a high differential pressure acting on the sealant and pushing it through the voids during solidification. When fractured zones are encountered during drilling operations, significant losses of drilling mud and other drilling fluids may be reduced or prevented. Interruptions and suspensions of normal drilling operations may be eliminated or reduced, and non-productive time may thus be minimized. Further, loss circulation events may be remedied without any requirement of running and cementing casing across the fractured zone. Finally, drilling through highly fractured zones may be simplified.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A tool for use in drilling operations comprising:

a cylindrical tool body having connecting portions at first and second ends thereof for connection of said tool body into a drill string;

a central bore extending through the tool body from said first end to said second end;

a port extending through said tool body and providing fluid communication between said central bore and an external environment outside of said tool; and a displaceable cover slidably positioned within the central bore, movable from a first position in which said cover sealingly closes and prevents fluid communication through said port, to a second position in which said port is open for allowing said fluid communication between said central bore and an external environment outside of said tool, wherein said tool body is configured to receive a container comprising a sealant, and wherein said container, when received by said tool body, displaces said displaceable cover from said first position to said second position.

2. The tool of claim 1, further comprising:

a container seat face formed on the surface of said central bore and configured to position said container within said tool body, and wherein, when said container is positioned by said container seat face, an opening in said container is aligned with said port extending through said tool body.

3. The tool of claim 2, further comprising:

a stabilizer pad extending radially outwardly and positioned on an outer circumferential surface of said tool body, said stabilizer pad having a sealant displacement slot therein, said port extending through said tool body being positioned within said slot.

4. The tool of claim 3, wherein said stabilizer pad is configured as a helical structure about said cylindrical tool body, and wherein a helical angle of the helical structure is between 5 to degrees.

5. The tool of claim 3, wherein the sealant is a rapidly solidifying sealant configured to harden when exiting the displacement slot.

6. The tool of claim 1, wherein the tool is disposed as part of a downhole BHA and wherein the tool is configured to inject the sealant into a fracture of a formation.

7. A system for sealing a fractured formation in a wellbore including the tool of claim 3, said container comprising:

a latching mechanism for engaging and positioning said container within said tool body in mechanical association with said container seat face;

a chamber for storing said sealant therein; and a piston for ejecting said sealant from said chamber into said port extending through said tool body.

8. The system of claim 7, wherein said port extending through said tool body comprises first and second channels that are separated and in fluid isolation from each other at their inner ends, and that are adjacent at their outer ends terminating in said displacement slot.

9. The system of claim 8, said opening in said container comprising:

first and second container ports that are separated from each other and which are configured to align with said first and second channels of said port when said container is positioned within said tool body by said latching mechanism.

10. The system of claim 9, said chamber of said container comprising:

first and second compartments for storing respective first and second components of a multi-part sealant in an unmixed condition.

11. The system of claim 10, wherein said tool and container are configured so that, when said container is positioned within said tool body by said latching mechanism, and when said piston is activated to eject said sealant from said chamber, said first component of said multi-part sealant is flowed through said first channel of said port extending through said tool body, said second component of said multi-part sealant is flowed through said second channel of said port extending through said tool body, said first and second components are mixed upon exiting said port, and said mixed sealant components are injected or flowed into voids of said fractured formation.

* * * * *